US006732483B1

(12) United States Patent
White

(10) Patent No.: US 6,732,483 B1
(45) **Date of Patent: *May 11, 2004**

(54) MODULAR PLASTIC PILE SYSTEMS AND METHODS

(75) Inventor: John L. White, Kent, WA (US)

(73) Assignee: American Piledriving Equipment, Inc., Kent, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/213,717

(22) Filed: Aug. 6, 2002

Related U.S. Application Data

(63) Continuation of application No. 09/699,271, filed on Oct. 25, 2000, now Pat. No. 6,427,402.

(51) Int. Cl.[7] ..... E02C 3/00
(52) U.S. Cl. ..... 52/592.1; 52/731.3; 52/721.4
(58) Field of Search ..... 52/589.1, 721.4, 52/731.3, 592.1; 405/267

(56) References Cited

U.S. PATENT DOCUMENTS

| | | | | | |
|---|---|---|---|---|---|
| 500,780 | A | | 7/1893 | Simon | |
| 910,421 | A | | 1/1909 | Schlueter | |
| 999,334 | A | * | 8/1911 | Pearson | 405/281 |
| 1,684,816 | A | | 9/1928 | Arden | |
| 2,101,285 | A | | 12/1937 | Stevens | |
| 2,128,428 | A | | 8/1938 | Murray, Jr. | |
| 2,232,845 | A | | 2/1941 | Fieroh | |
| 3,059,436 | A | | 10/1962 | Hermann, Jr. | |
| 3,411,305 | A | | 11/1968 | Cella | |
| 3,999,392 | A | | 12/1976 | Fukushima et al. | |
| 4,351,624 | A | | 9/1982 | Barber | |
| 4,519,729 | A | * | 5/1985 | Clarke et al. | 405/129.6 |
| 4,632,602 | A | * | 12/1986 | Hovnanian | 405/129.8 |
| 5,106,233 | A | | 4/1992 | Breaux | |
| 5,117,925 | A | | 6/1992 | White | |
| 5,240,348 | A | | 8/1993 | Breaux | |
| 5,244,316 | A | | 9/1993 | Wright et al. | |
| 5,388,931 | A | | 2/1995 | Carlson | |
| 5,544,979 | A | | 8/1996 | White | |
| 5,609,380 | A | | 3/1997 | White | |
| 5,653,556 | A | | 8/1997 | White | |
| 5,794,716 | A | | 8/1998 | White | |
| 6,039,508 | A | | 3/2000 | White | |
| 6,427,402 | B1 | * | 8/2002 | White | 52/292 |

FOREIGN PATENT DOCUMENTS

| | | |
|---|---|---|
| JP | 57-9917 | 1/1982 |
| JP | 59-228529 | 12/1984 |
| JP | 4-97015 | 3/1992 |
| NO | 46428 | 4/1929 |

* cited by examiner

*Primary Examiner*—Carl D. Friedman
*Assistant Examiner*—Basil Katcheves
(74) *Attorney, Agent, or Firm*—Michael R. Schacht; Schacht Law Office, Inc.

(57) ABSTRACT

A modular pile system. The pile system comprises first and second cylindrical plastic pile members and a detent system. Each of the pile members has an upper end and a lower end. The detent system connects the upper end of the first pile member to the lower end of the second pile member. The detent means allow the second pile member to be displaced into a desired position relative to the first pile member but substantially prevent relative movement between the first and second pile members when the second pile member is in the desired position.

11 Claims, 9 Drawing Sheets

MODULAR PLASTIC PILE SYSTEMS AND METHODS

RELATED APPLICATIONS

This is a continuation of application Ser. No. 09/699,271, filed Oct. 25, 2000, now U.S. Pat. No. 6,427,402.

TECHNICAL FIELD

The present invention relates to pile systems and methods and, more specifically, to pile systems and methods made of plastic.

BACKGROUND OF THE INVENTION

Piles are a common feature of modern construction techniques, often forming a footing for a structure, a part of or support for a retaining wall, an underground fluid flow barrier, or extending above the ground to support a structure suspended above ground.

Piles can be fabricated in many sizes and shapes and can be made of many different materials. Piles are most commonly made of steel, wood, or concrete. Wood or concrete piles most commonly take the shape of a solid rectangle or cylinder, while steel piles most commonly are manufactured in the form of a hollow cylinder. However, generally planar sheet piles made of steel, concrete, or plastic are also used to some extent.

During use, piles normally extend at least partly into the ground. Numerous techniques may be used to bury the pile in the ground. One such technique is to excavate a hole using conventional techniques, place the pile into the hole, and then backfill the hole to secure the pile in place. A more common technique is to drive the pile into the earth by applying a force to the upper end of the pile.

Pile driving systems take many forms. A simple drop hammer system raises a weighted member and drops it onto the upper end of the pile. A gear or roller drive system engages the sides of the pile to crowd the pile into the earth. A vibratory hammer system uses a pair of balanced, counter-rotating eccentric weights to create a vibratory force that drives the pile into the earth. Supported hydraulic pistons can ram the pile a relatively short distance into the earth. An auger system rotates the pile about its longitudinal axis to drill the pile into the earth. When properly configured, two or more of these techniques can be combined.

Pile driving systems are, generally speaking, faster, less expensive, and more convenient than excavating techniques. However, with certain pile shapes and materials, pile driving systems are not available.

For example, sheet pile is often used for uses such as retaining walls or underground fluid barriers. Sheet pile defines elongate upper and lower edges; applying a driving force to the upper edge to drive the lower edge into the ground can cause the sheet pile to buckle and fail if significant in-ground resistance is met. Sheet pile is thus most commonly buried in the ground using excavation and backfilling.

Conventionally, sheet pile is made of steel. More recently, sheet piles have been made of plastic. Conventional plastic sheet piles are similar in configuration to metal sheet piles; usually, two or three vertical panels are joined at vertical lines (one panel may be bent, molded, or extruded to form the vertical lines) and define first and second vertical edges. The panels are angled with respect to each other to provide additional strength. Some plastic piles further define an elongate ball and socket connection on the vertical edges that strengthens the juncture between adjacent piles.

When functioning as a pile, plastic has many desirable properties. However, plastic can be even more susceptible to buckling and failure when driven by conventional pile driving techniques.

The need thus exists for improved pile systems and more specifically to improved piles and systems and methods for driving piles.

RELATED ART

A professional patentability search conducted on behalf of the applicant turned up the following U.S. patents.

| U.S. PATENTS | | |
|---|---|---|
| U.S. Pat. No. | Patentee | Title |
| 5,244,316 | Wright et al. | Borer-Resistant Waterfront Retaining Bulkhead |
| 5,240,348 | Breaux | Methods of Hazardous Waste Containment |
| 5,388,931 | Carlson | Cutoff Wall System to Isolate Contaminated Soil |
| 4,351,624 | Barber | File and Jacket construction Method and Apparatus |
| 3,059,436 | Hermann, Jr. | Piling |
| 2,128,428 | Murray, Jr. | Sheet Piling |
| 2,101,285 | Stevens | Tubular interlocking Piling |
| 910,421 | Schleuter | Interlocking Construction for Docks, Piers, Jetties, Building Foundations. . . |
| 500,780 | Simon | Pile Planting |

| FOREIGN PATENTS | |
|---|---|
| Japanese 59-228529 | Formation of Sheathing Continuous Wall and Rotary Excavator and Sheathing Member Therefor |
| Japanese 4-97015 | Water-Stop Joint for Steel Tubular Pile |
| Japanese 57-9917 | Erecting Method for Sheet Pile and Device Thereof |
| Nonwegian 46428 | |

The Breaux patent discloses an underground wall system for containing hazardous waste that uses cylindrical plastic rail members with interlocking portions that are buried in the ground. Nothing in the Breaux patent discloses, teaches, or suggests using these cylindrical members as piles that are driven into the earth with a vibratory hammer or any other type of pile driver. To the contrary, the Breaux patent describes excavating a trench around the area to be isolated, placing the cylindrical members in the trench, and then back-filling to bury the members. The Breaux patent also describes the use of a guide box to arrange the members within the trench and a system for forming a seal between adjacent members.

The Carlson and Japanese '529 patents are similar to the Breaux patent in that they relate to containment systems. The systems described in these patents employ slotted cylindrical members. As with the Breaux system, the members are buried in a previously excavated trench. The Carlson members are apparently plastic, and the Japanese '529 members are steel. Neither one appears to be appropriate for driving into the ground.

The Schlueter, Stevens, Hermann, Simon, Murray, Norwegian '428, and Japanese '015 patents all disclose or appear to disclose tubular pile system employing interlocking pile members. All of these patents appear to employ conventional elongate metal members modified to have an interlocking system for joining the members together along their edges. The patents do not relate to plastic sheet piles and/or methods for allowing plastic sheet piles to be driven using a vibratory piledriver.

The Barber patent discloses a guide sleeve for piles that is driven first and through which conventional piles are subsequently driven. The Barber patent states that the piles may be joined end to end.

The Wright et al. patent discloses a bulkhead system in which piles that form the face of the wall are connected to an anchor using horizontal tension members.

The Japanese '917 patent discloses interlocking tubular sheet piles that are inserted into pre-bored holes.

SUMMARY OF THE INVENTION

The present invention is a modular pile system. The pile system comprises first and second cylindrical plastic pile members and a detent system. Each of the pile members has an upper end and a lower end. The detent system connects the upper end of the first pile member to the lower end of the second pile member. The detent means allow the second pile member to be displaced into a desired position relative to the first pile member but substantially prevent relative movement between the first and second pile members when the second pile member is in the desired position.

The objects of the present invention can be obtained using many different embodiments of the present invention in different configurations depending upon the end use to which the pile members are wall system formed thereby is to be put.

DETAILED DESCRIPTION OF THE INVENTION

Figure 2:
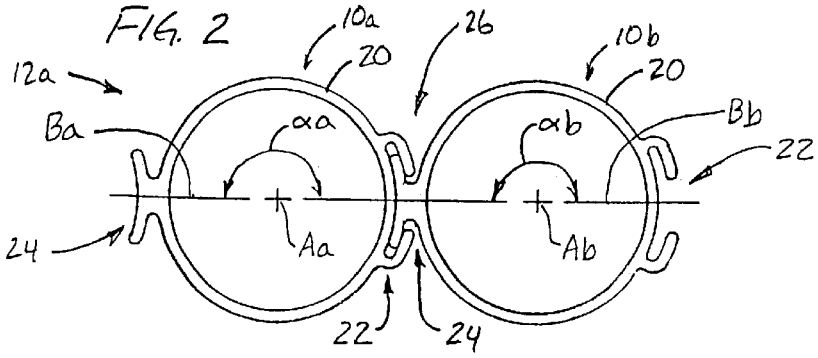
FIG. 2 is a top plan view depicting two of the pile members of FIG. 1 interconnected according to the principles of the present invention.

Referring now to the drawing, depicted at 10*a* and 10*b* in FIG. 2 therein are first and second pile members constructed in accordance with, and embodying, the principles of the present invention. The exemplary pile members 10*a* and 10*b* are joined together to form a wall system 12*a*.

Figure 3:
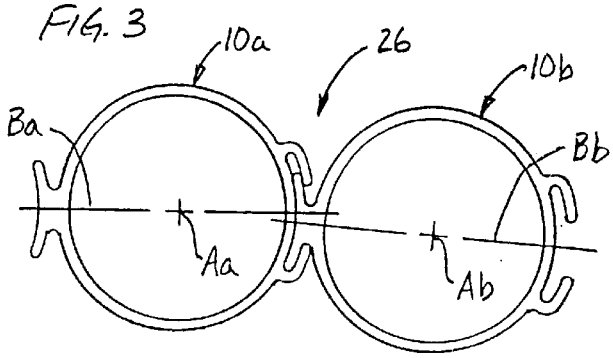
FIG. 3 depicts two pile members of the present invention interconnected with their connection angles misaligned.

Each of the exemplary pile members 10 each comprises a body portion 20, a channel portion 22, and a rail portion 24. As shown in FIGS. 2 and 3, the channel portion 22 of the first pile member 10 receives the rail portion 24 of the second pile member 12*a* to form a locking system 26 that connects the first and second pile members 10*a* and 10*b*.

Each of the exemplary pile members 10*a* and 10*b* define longitudinal axes Aa and Ab and reference planes Ba and Bb that in turn define connection angles $\alpha$a and $\alpha$b. The connection angles $\alpha$a and $\alpha$b associated with the pile members 10*a* and 10*b* are both 180°. Accordingly, when the pile members 10*a* and 10*b* are connected together to form the wall system 12*a*, the wall system 12*a* is generally planar as shown in FIG. 2. But as will be described in further detail below, FIG. 3 illustrates that the locking system 26 allows the reference planes Ba and Bb associated with the first and second pile members 10*a* and 10*b* to extend at an angle to each other.

In practice, a wall system constructed using pile members as described herein may comprise more than two pile members. If the reference axes B of the pile members are aligned, the wall system will be substantially planar. If the reference axes B of adjacent pile members 10 are not aligned, the wall system will be curved.

Figure 4:
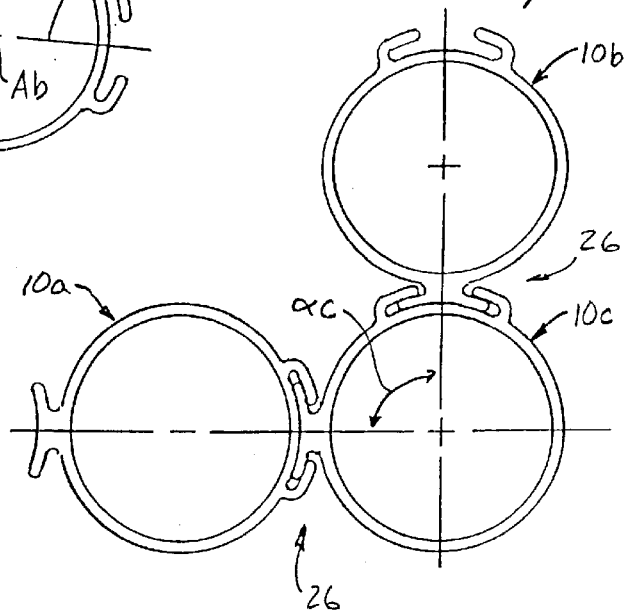
FIG. 4 depicts three pile members, one of which has a connection angle of approximately 90 degrees.

FIG. 4 illustrates a wall system 12*b* employing a third pile member 10*c* in addition to the first and second pile members

10*a* and 10*b* described above. The reference angle αc associated with the third pile member 10*c* is 90°. Accordingly, the wall system 12*b* forms a right angle and could be used as part of a larger wall system to turn a corner.

The exemplary pile members 10*a* and 10*b* are identical, but the present invention may be embodied in wall systems, such as the wall system 12*b* of FIG. 4, using pile members that are not identical. In particular, the present invention may be embodied in another form with a pile member having only a channel portion or a rail portion.

Figure 5:
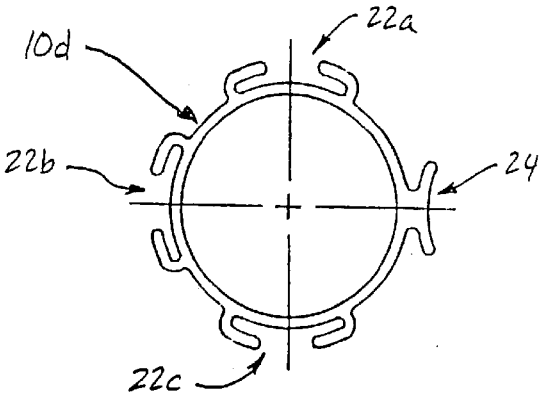
FIG. 5 is a top plan view of a pile member having multiple connection angles.

In addition, shown in FIG. 5 is a pile member 10*d* having a single rail portion 24 and three channel portions 22*a*, 22*b*, and 22*c*. The pile member 12*d* could be used for both straight wall sections and to turn a corner in either direction. A similar effect could be obtained by a pile member comprising a single channel portion 22 and two or three rail portions 24.

Figure 1:
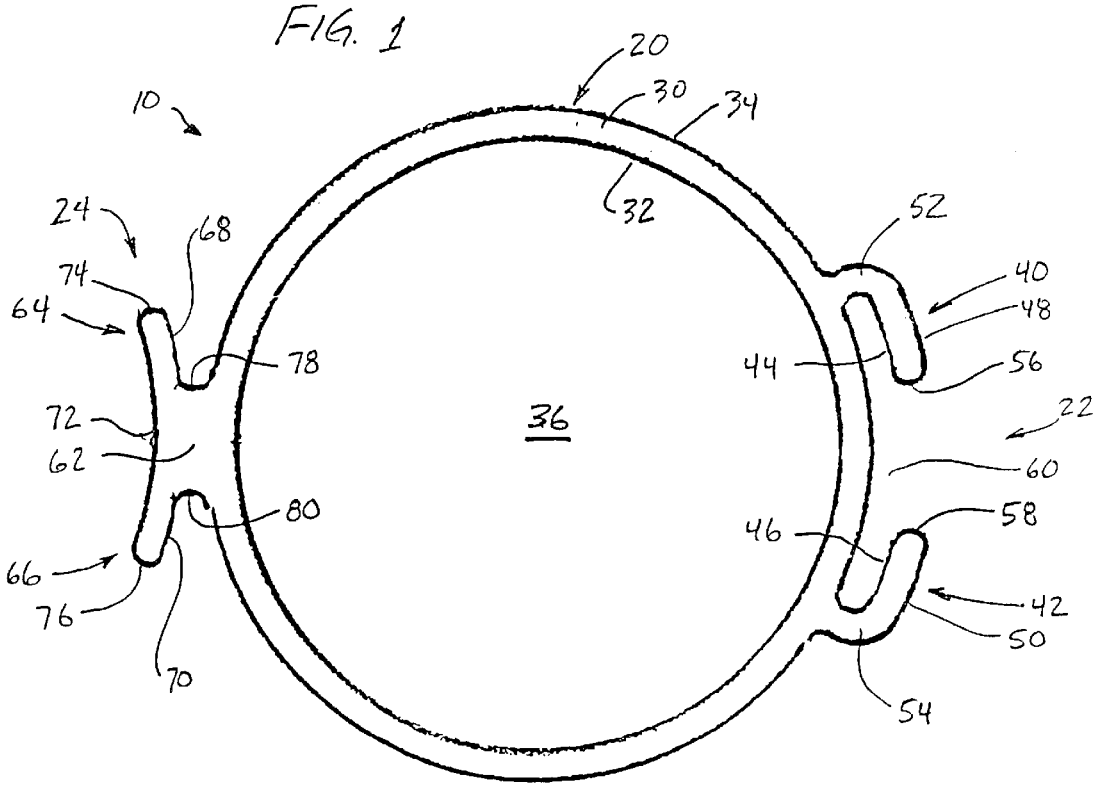
FIG. 1 is a top plan view of a pile member constructed in accordance with, and embodying, the principles of the present invention.

Referring now to FIG. 1, the body portions 20, channel portions 22, and rail portions 24 of the exemplary pile members 10*a*, 10*b*, 10*c*, and 10*d* will now be described in further detail.

The exemplary body portions 20 are formed by a wall 30 in the shape of a hollow cylinder and defining an inner surface 32 and an outer surface 34. The inner surface 32 defines a pile chamber 36 that extends the length of the pile member 10. The pile chamber 36 is open at its upper and lower ends to define first and second end openings 37 and 38 in the pile member 10. Other shapes of the body portions 20 are possible, but the hollow cylindrical wall 30 yields a good combination of high strength and low weight. In addition, the open ends 37 and 38 decrease resistance to driving.

The exemplary channel portions 22 each comprise first and second channel arms 40 and 42. The channel arms 40 and 42 define first and second inner surfaces 44 and 46 and first and second outer surfaces 48 and 50. The channel arms 40 and 42 comprise first and second elbow portions 52 and 54 and first and second tip portions 56 and 58. The inner surfaces 44 and 46 oppose the outer surface 34 of the main body to form a receiving channel 60.

The exemplary rail portions 24 each comprise a neck portion 62 and first and second rail flanges 64 and 66. The rail portions 24 define first and second inner surfaces 68 and 70, an outer surface 72, and first and second rail tips 74 and 76. First and second juncture surfaces 78 and 80 are formed on the neck portion 62.

The exemplary rail portions 24 are generally curved to match the radius of curvature of the outer surface 34 of the body portion 20. Similarly the channel arms 40 and 42 are curved with substantially the same radius of curvature. Accordingly, the inner surfaces 44 and 46 and outer surfaces 48 and 50 of the channel arms 40 and 42 and the inner surfaces 68 and 70 and outer surface 72 of the rail portions 24 are all similarly curved to allow the rail portions 24 to be received within the receiving channel 60.

The distance between the elbow portions 52 and 54 and their associated tip portions 56 and 58 is approximately the same as the distance between the juncture surfaces 78 and 80 of the neck portion 62 and the rail tips 74 and 76 associated with these juncture surfaces 78 and 80. However, the thickness of the neck portion 62 between the juncture surfaces 78 and 80 is less than the gap between the tip portions 56 and 58.

The exact geometry of the channel portions 22 and rail portions 24 is not essential to any implementation of the present invention. Other shapes and configurations can be used; any structure may be used that allows the pile members 10 to be driven into the ground as recited herein and helps to maintain the reference axes B of the installed pile members 10 in alignment when installed. The geometry described herein is preferred because it meets the foregoing objectives and allows the reference axes B of the interlocked pile members 10 to be aligned (FIG. 2) to obtain a substantially planar wall system or slightly mis-aligned (FIG. 3) within a small angle to obtain curved wall systems as generally discussed above.

The material from which and manufacturing process by which the pile members 10 of the present invention are made are not critical to most implementations of the present invention. However, in the most preferred implementation of the present invention, the pile members are made of extruded plastic. Manufacturing methods for making such extruded plastic parts are sufficiently advanced that the pile members of the present invention may be manufactured reliably and on a large scale at relatively low cost. These techniques are also suited for manufacturing hollow pile members to reduce material expense.

Other materials, such as metal, ceramics, paperboard, and the like may appropriate depending upon the end use of the pile member. In addition, combinations of such materials may be appropriate. As examples, a metal, fiberglass, or paperboard core may be coated on the inside or outside with plastic, ceramics, metal, and/or the like, as required by the given application.

Figure 6:
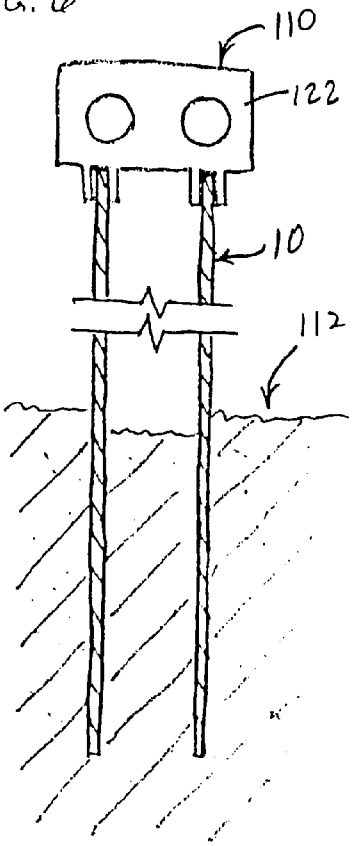
FIG. 6 is a side elevation partial cut-away view depicting a pile member as shown in FIGS. 1–5 being driven by a vibratory device.

In many situations, a pile member of the present invention may be directly driven into the ground using conventional pile driving techniques. For example, shown at 110 in FIG. 6 is a vibratory hammer that engages the upper end of the pile member 10 to drive the pile member 10 into the ground 112. The effective cross-sectional area of the pile member 10 that faces down is relatively small, which decreases resistance to driving. This technique works very well, especially when the soil is relatively soft.

In other situations, however, the soil may prevent the pile members from being directly driven into the ground. This is especially true when the pile members are, as is preferred, made of plastic. FIGS. 7–11 show systems and methods that enable the exemplary pile members 10 to be driven into more resistant soils, especially when the pile members 10 are made of plastic.

Figure 7:
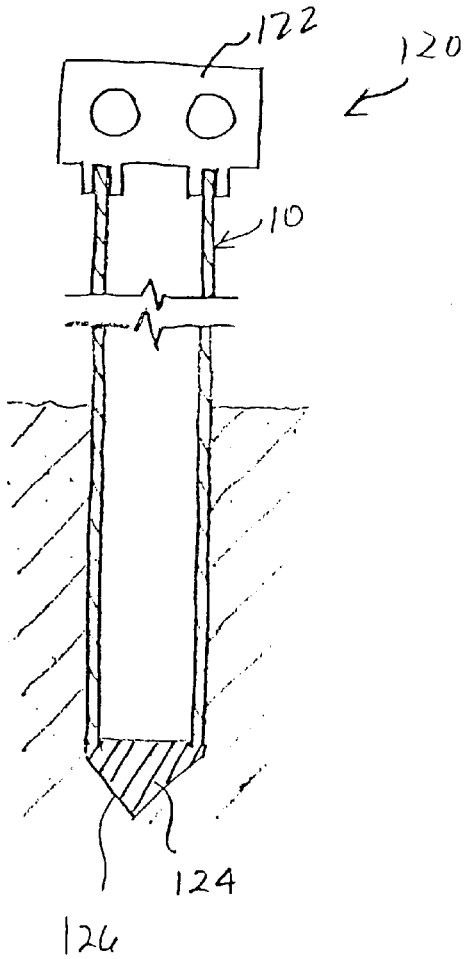
FIG. 7 is a side elevation partial cut-away view depicting a pile member of the present invention being driven with a vibratory device and employing a shoe member to facilitate movement of the pile member through the earth.

Referring initially to FIG. 7, depicted therein is a system 120 for driving the pile member 10 comprising a vibratory hammer 122 and a shoe member 124. The shoe member 124 comprises a conical surface 126 configured to displace the soil as the vibratory hammer 122 engages the upper end of the pile member 10 to improve the ability of the pile member 10 to move through the soil.

Figure 8:
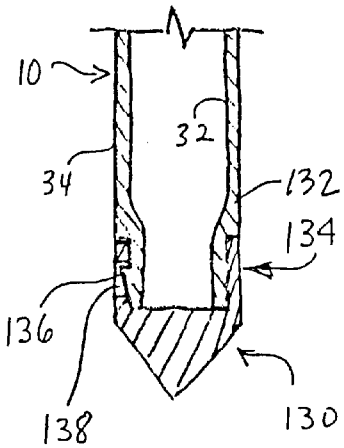
FIG. 8 is a side elevation cut-away view depicting a shoe member adapted to be detachably attached to a lower end of a pile member.

FIG. 8 depicts a shoe member 130 that functions in the same basic manner as the shoe member 124 described above but is adapted to be positively attached to a lower end 132 of the pile member 10. In particular, the exemplary shoe member 130 comprises a cylindrical portion 134 that snugly fits on the lower end 132 of the pile member 10. A detent portion 136 extending from the cylindrical portion 134 snap fits into a hole 138 formed in the pile lower end 132.

The detent portion 136 thus engages the pile lower end 132 such that relative movement between pile member 10 and shoe member 130 is inhibited. When a vibratory device directly engages the pile member 10, up and down vibratory forces are applied to the shoe member 130 through the pile member 10. Attaching the shoe member 130 to the pile member 10 increases the efficiency with which the upward vibratory forces are transmitted to the shoe member 130.

Other attachment systems may be used. For example, the shoe member may simply be adhered to the pile lower end 132 using conventional plastic adhesives or attached by friction between the cylindrical portion 134 of the shoe member 130 and either the inner surface 32 or outer surface 34 of the pile body portion 20.

Figure 9:
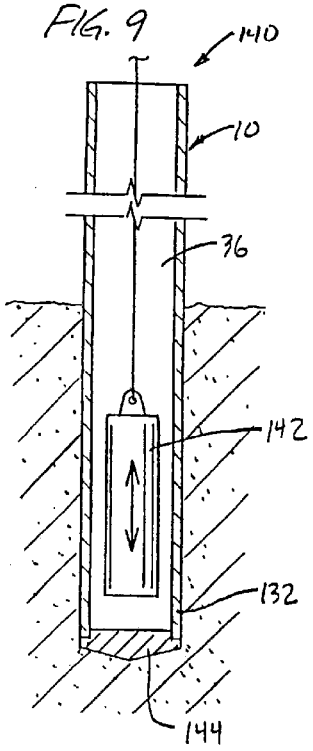
FIG. 9 is side elevation partial section view depicting the use of a drop hammer pile driving system and a shoe member to drive a pile member of the present invention.

Referring now to FIG. 9, depicted at 140 therein is a driving system employing a drop hammer 142 and a shoe member 144. As with the shoe members 124 and 130 described above, the shoe member 144 engages the lower end 132 of the pile member 10. The drop hammer 142 is raised and dropped within the pile chamber 36 directly against the shoe member 144. The shoe member 144 thus creates a pilot hole for the pile member 10.

The pile member 10 can be separately driven into the pilot hole in synchrony with movement of the drop hammer 142, or the shoe member 144 may be connected to the pile member 10 as in the case of the shoe member 130 described above. In either case, the pile member 10 can be driven into the earth without direct application of large driving forces to the pile member 10. The benefit of the driving system 140 and variations thereon is that pile members made of a relatively soft material such as paperboard or plastic may be driven without deformation of the pile member.

Figure 10:
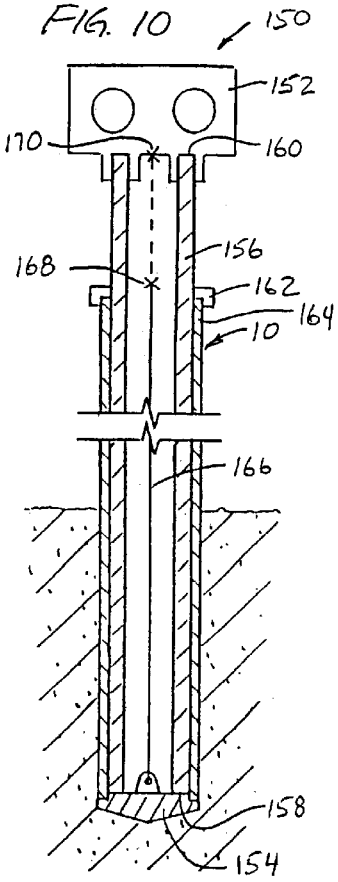
FIGS. 10–11 are side elevation partial cut-away views depicting the use of a insert member that is driven by a vibratory device to insert a pile member of the present invention into the ground.
Figure 11:
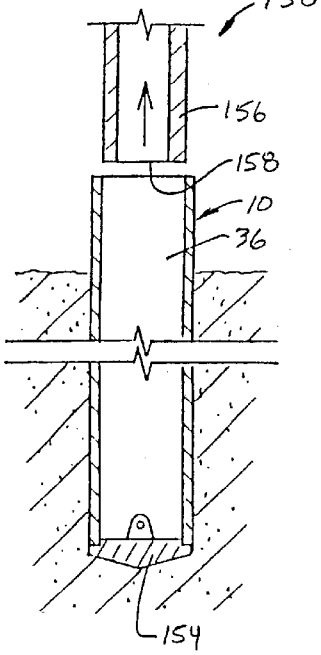

FIGS. 10 and 11 depict a pile driving system 150 that, like the system 140 described above, may be used to a drive pile member 10 in relatively resistant soil and/or to drive a pile member 10 made of relatively soft material. The pile driving system 150 comprises a vibratory device 152, a shoe member 154, and an insert member 156. As with the shoe members 124, 130, and 144 described above, the shoe member 154 is arranged at the bottom end of the pile 10. And like the pile driving system 140 described above, the pile driving system 150 drives the pile member 10 without requiring the main driving forces to be applied to the pile member 10.

In particular, the insert member 156 is a rigid member that carries the main driving force through the pile member 10 and to the shoe member 154. As shown in FIG. 10, the insert member 156 is inserted through the pile chamber 36. The exemplary insert member 156 is longer than the pile member 10, so a bottom end 158 of the insert member 156 engages the shoe member 154 and an upper end 160 of the insert member 156 extends out of the pile chamber 36. Vibratory forces are then applied to the insert member 156 and through the insert member 156 to the shoe member 154 to drive the shoe member 154 to create the pilot hole. In the system 150, the insert member 156 is subsequently withdrawn from the pile chamber 36 as shown in FIG. 11.

The insert member 156 may be any rigid member capable of withstanding the driving forces necessary to drive the shoe member into the earth. However, the Applicant has found that relatively inexpensive industry standard steel pipe can be used as the insert member 156.

As the pilot hole is created, the pile member 10 may be separately driven or forced into the pilot hole following the shoe member 154. However, the exemplary system 150 comprises a follower flange 162 formed on the insert member 156. The follower flange 162 engages an upper end 164 of the pile member 10 such that the pile member 10 is forced into the pilot hole following the shoe member 154. The follower flange 162 is optional as will become apparent from the following discussion.

The exemplary pile driving system 150 further comprises a tension cable 166 connected between the shoe member 154 and either a first location 168 on the insert member 156 or a second location 170 on the vibratory device 152. If the tension cable 166 is connected to the first location 168 and the vibratory device 152 is rigidly clamped onto the insert member 156, both the up and the down vibratory forces will be cleanly transmitted to the shoe member 154. Similarly, if the tension cable is connected to the second location 170, the insert member 156 is securely held between the shoe member 154 and the vibratory device 156 such that upward as well as the downward the vibratory forces will be transmitted to the shoe member 154. If used, the tension cable 166 is removed to allow the insert member 156 to be removed from the pile chamber 36.

Figure 12:
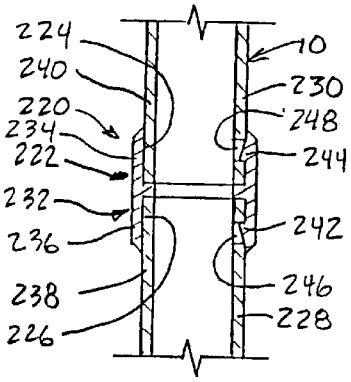
FIGS. 12–14 are side elevation cut-away views depicting three exemplary coupling systems for coupling pile members of the present invention end-to-end.
Figure 13:
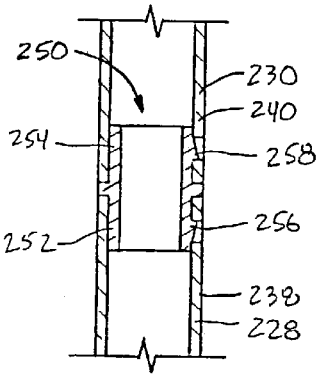
Figure 14:
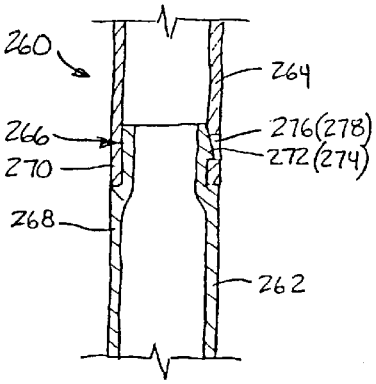

Referring now to FIGS. 12–14, depicted therein are connection systems that allow the pile members 10 to be formed out of two or more short sections or segments.

In particular, FIG. 12 depicts a connection system 220 that employs a connecting member 222 and first and second connecting holes 224 and 226 to connect first and second pile member sections 228 and 230. The exemplary connecting member 222 comprises a circular central portion 232 and first and second cylindrical portions 234 and 236. The exemplary cylindrical portions 234 and 236 are sized and dimensioned to fit snugly around an upper end 238 of the first, lower, pile section 228 and a lower end 240 of the second, upper, pile section 230. So assembled, the central portion 232 is arranged between the upper and lower ends 238 and 240 of the pile member sections 228 and 230.

As with the shoe member 130 described above, the connecting member 222 need not but may be connected to the pile member sections 228 and 230. The exemplary connecting member 222 comprises first and second detent members 242 and 244 that engage first and second holes 246 and 248 in the pile member sections 228 and 230. Again, other connecting systems, such as adhesives or friction fit, may be used in place of the exemplary detent members and holes described herein. A simple variation on the system disclosed in FIG. 12 is to switch the locations of the holes and the detents.

In addition, as shown in FIG. 13, a connecting member 250 may be configured with cylindrical portions 252 and 254 that fit within the ends 238 and 240 of the pile member sections 228 and 230. As with the connecting member 222, detents 256 and 258 or other connection systems may be used to secure the connecting member to the pile member sections 228 and 230.

Referring now to FIG. 14, depicted therein is a connecting system 260 for connecting first and second pile sections 262 and 264. In the exemplary system 260, the connecting system is entirely formed in the pile sections 262 and 264, obviating the need for a separate connecting member.

In particular, an altered diameter portion 266 is formed on one of the pile sections 262; in this case, the altered diameter portion 266 is a reduced diameter portion formed on an upper end 268 of the first, lower, pile section 262 that is sized and dimensioned to fit within a lower end 270 of the second, upper, pile section 264.

The altered diameter portion may also be an increased diameter portion sized and dimensioned to fit around the lower end 270. In addition, the position of the altered diameter portion may be switched to the lower end 270 of the second, upper, pile section 264, with the upper end 268 of the first pile section 262 being received by or surrounding the lower end 270.

Preferably, all of the pile sections would be identical and could be coupled together indefinitely. In addition, the connecting system used for the pile sections could be the same as that used for the shoe member so that the shoe member is connected to the first pile section driven into the earth and then subsequent pile sections are connected using the same connecting system.

The exemplary connecting system 260 employs detent members 272 and 274 formed on the altered diameter portion 266 and holes 276 and 278 formed in the lower end 270 of the second pile section 264. Again, the positions of the detent members and holes could be reversed or the detent portions and holes could be eliminated in favor of another connecting system such as friction fit or adhesive.

An important advantage of using a connecting system to connect multiple pile member sections together is that the length of the parts can be kept to a minimum for manufacturing, shipment, storage, and installation. In addition, the height of the pile member above the ground can also be reduced for a given depth to which the pile is to be driven, simplifying the process of driving the pile member. Also, relatively short pile member sections reduces the likelihood of buckling and failure during the process of driving the pile member.

Figure 15:
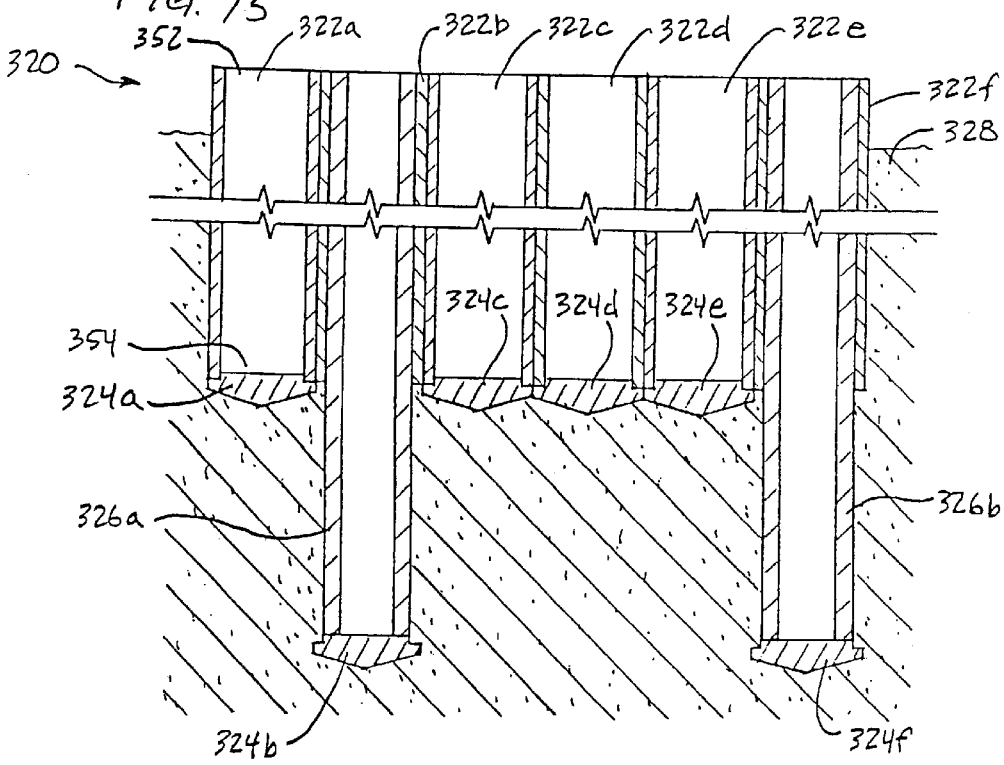
FIG. 15 is a front elevation cut-away view depicting an exemplary wall system employing pile members of the present invention.

Referring now to FIG. 15, depicted therein is a wall system 320 comprising first through sixth pile members 322*a–f*, first through sixth shoe members 324*a–f*, and first and second insert members 326*a,b*. The wall system 320 is supported by the ground as indicated at 328.

The first and third through fifth pile members 322*a* and 322*c–g* are driven by any of the methods described above, including with the use of insert members that have been removed. The second and sixth pile members 322*b* and 322*f* have been driven using the insert members 326*a* and 326*b*. However, instead of removing the insert members 326*a* and 326*b* after the pile members 322*a* and 322*f* are driven to the desired depth, the insert members 326*a* and 326*b* are further driven into the earth and left in place.

The insert members 326*a* and 326*b* reinforce the connection between the wall system 320 and the ground 328. In the exemplary wall system 320, the insert members 326*a* and 326*b* are separated by three pile members 324*c*, 324*d*, and 324*e*. In general, the spacing between the left-in-place insert members 326 will depend upon the use to which the wall will be put. For example, if the wall is to function as a fence, the insert members 326 may be spaced from each other by numerous pile members 324. On the other hand, for a tall retaining wall against which a large amount of unstable earth has been backfilled, the insert members 326 may be left in place inside all of the pile members 324.

Figure 16:
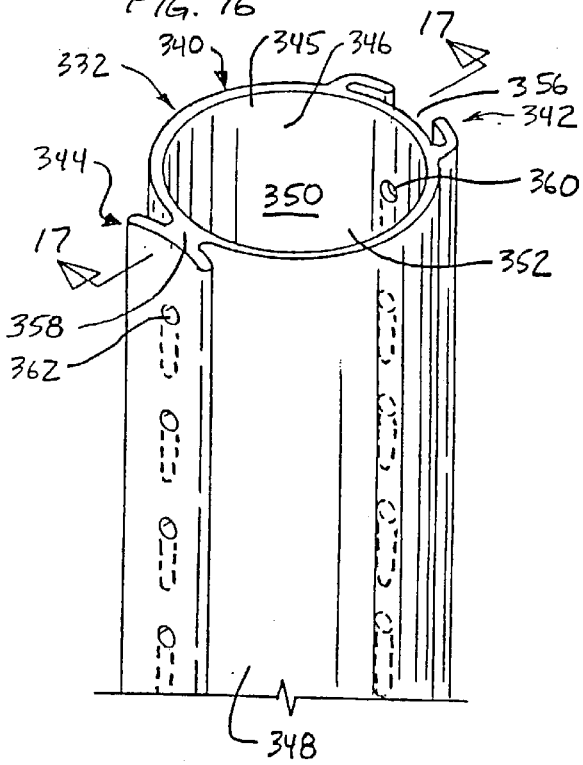
FIG. 16 is a perspective view of a pile member of FIGS. 1–5 having side openings that allow flowable, settable material to move from one pile member to an adjacent pile member.
Figure 17:
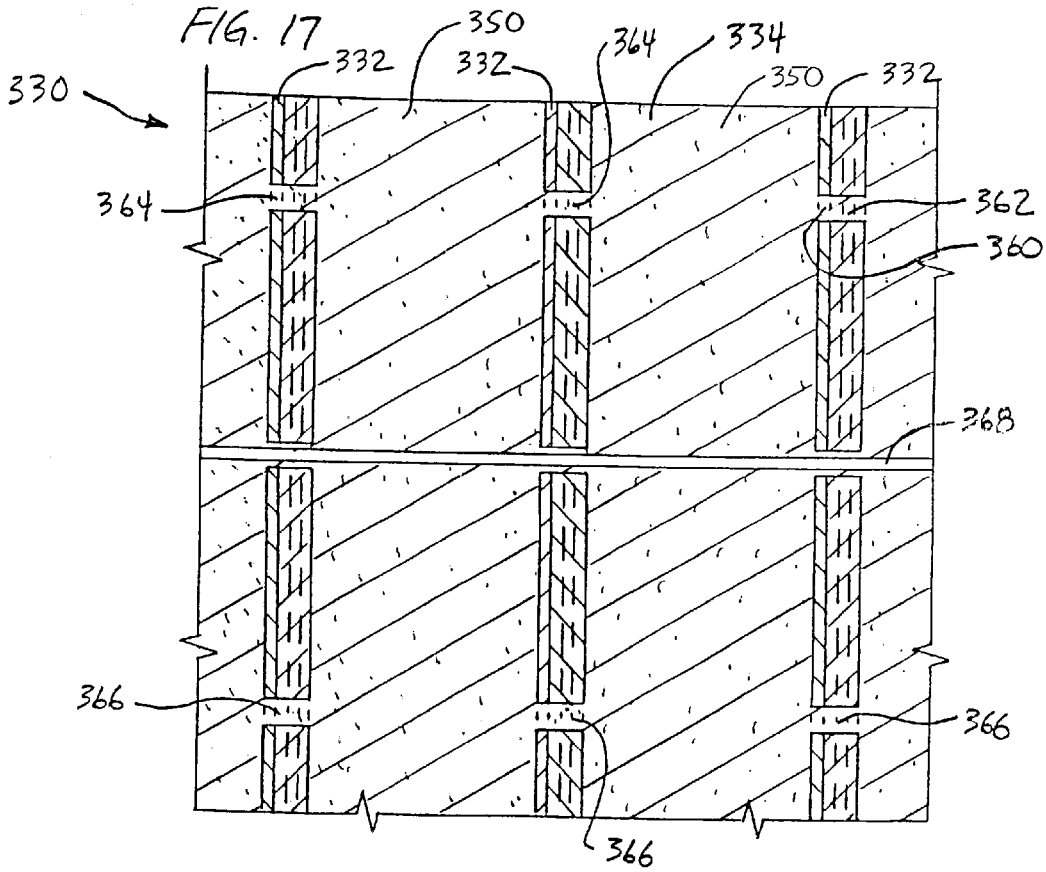
FIG. 17 is a partial section view of a wall system employing side openings as depicted in FIG. 16.

Referring now to FIGS. 16 and 17, depicted in FIG. 17 is a portion of a wall system 330 comprising a plurality of pile members 332 that have been filled with a settable material 334 such as concrete.

As shown in FIG. 16, the pile members 332 are similar to the pile members 10 described above in that they comprise a body portion 340, a channel portion 342, and a rail portion 344. The body portions 340 comprise a wall 345 that defines an inner surface 346 and an outer surface 348. The inner surface 346 defines a pile chamber 350. The ends of the chamber 350 are open to define first and second end openings 352 and 354. The channel portions 342 define a channel 356 and rail portions 344 define a neck portion 358; these portions 342 and 344 are or may be the same as the channel and rail portions 22 and 24 of the pile member 10.

The settable material 334 is introduced into pile chambers 350 through the first, upper, end opening 352 in a fluid state and then allowed to harden in a set state. The hardened settable material reinforces the pile members 332 to increase the rigidity of the wall system 330. The settable material 334 may be concrete, as mentioned above, but other materials may be used alone or in combination. For example, a fiber material may be distributed throughout concrete in a fluid state such that the fiber material reinforces the concrete when the concrete hardens to a set state.

The pile members 332 may be identical to the pile members 10 described above. However, the exemplary pile members 332 are provided with at least one channel side opening 360 and one rail side opening 362. Referring now back to FIG. 17, it can be seen that the channel side openings 360 at least partly align with the rail side openings 362 to create cross passageways 364 between the pile chambers 350 of adjacent pile members 332. The cross passageways 364 allow at least a portion of the settable material 334 to flow from one pile chamber 350 through the cross passageways 364 to the pile chambers 350 of the adjacent pile members 332. When the settable material 334 hardens into the set state, the portion of the settable material 334 in the cross passageways 364 forms a bridge portion 366 that helps to prevent relative movement between adjacent pile members 332.

The exemplary channel side opening 360 extends through the pile wall 345 and into the channel 356. The exemplary rail side opening 362 extends through the pile wall 345 and the neck portion 358 of the rail portion 344. Accordingly, as long as the channel portion 342 properly receives the rail portion 344, the channel and rail side openings 360 and 362 should be substantially co-planar. By matching the locations of the channel and rail side openings 360 and 362 and driving the pile members 342 to predetermined relative locations, the channel and rail side openings 360 and 362 can be accurately aligned to form the cross passageways 364.

Some benefit could be obtained by a single channel side opening 360 and single rail side opening 362. In this case, the channel and side openings 360 and 362 could be elongated to increase the side of the bridge portions 366 created thereby.

However, preferably a plurality of such side openings 360 and 362 are formed. A plurality of such openings will increase the overall resistance to shear movement between adjacent pile members 342 created by the bridge portions 366.

The channel and rail side openings 360 and 362 may be circular as shown by solid lines in FIG. 16; however, the openings may be elongate as shown by broken lines to increase the likelihood that the openings 360 and 362 will align and/or to increase the size of the bridge portions 366.

Referring again for a moment to FIG. 17, depicted at 368 therein is a rebar segment that is passed through a plurality of pairs of aligned channel and rail side openings 360 and 362. The rebar 368 substantially increases the ability of the bridge portion 366 to resist sheer movement between adjacent pile members 342.

Figure 18:
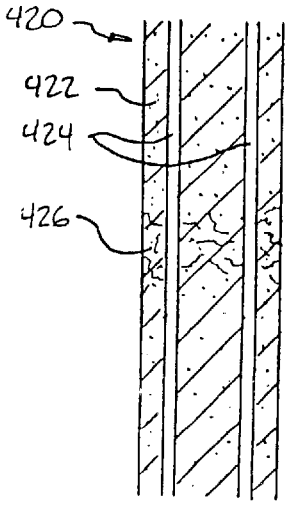
FIG. 18 PRIOR ART
FIGS. 18–19 depict prior art, unencapsulated piles or supports and how these piles or supports may fail when subjected to compression loads.
Figure 19:
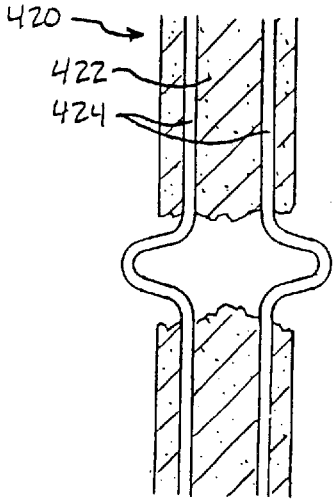
FIG. 19 PRIOR ART

Referring now to FIGS. 18 and 19, depicted at 420 therein is a prior art pile comprising a concrete portion 422 and reinforcing material 424. Over time, external stress created by normal use or catastrophic events such as earthquakes can weaken portions of the concrete as indicated by reference character 426. Concrete is normally highly effective at bearing compressive loads, but the weakened portion 426 can fail creating a pile failure as shown in FIG. 19.

Figure 20:
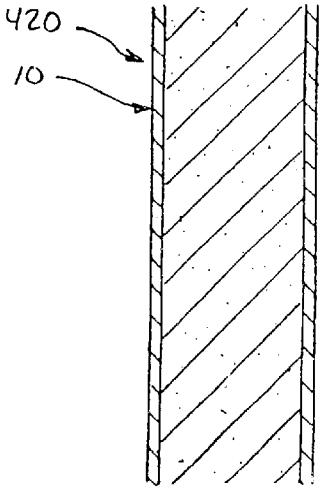
FIG. 20 is a side elevation cut-away view depicting a pile member as shown in FIG. 1 being used to encapsulate a pile or support.

Referring now to FIG. 20, depicted therein is the conventional pile 420 encapsulated using the pile member 10 constructed in accordance with the principles of the present invention. The pile member 10 can be made of material such as plastic or fiberglass that will help contain any weakened portions such as those indicated by reference character 426. Containing such weakened portions using the pile member 10 can prevent the catastrophic failure such as shown in FIG. 19.

Figure 21:
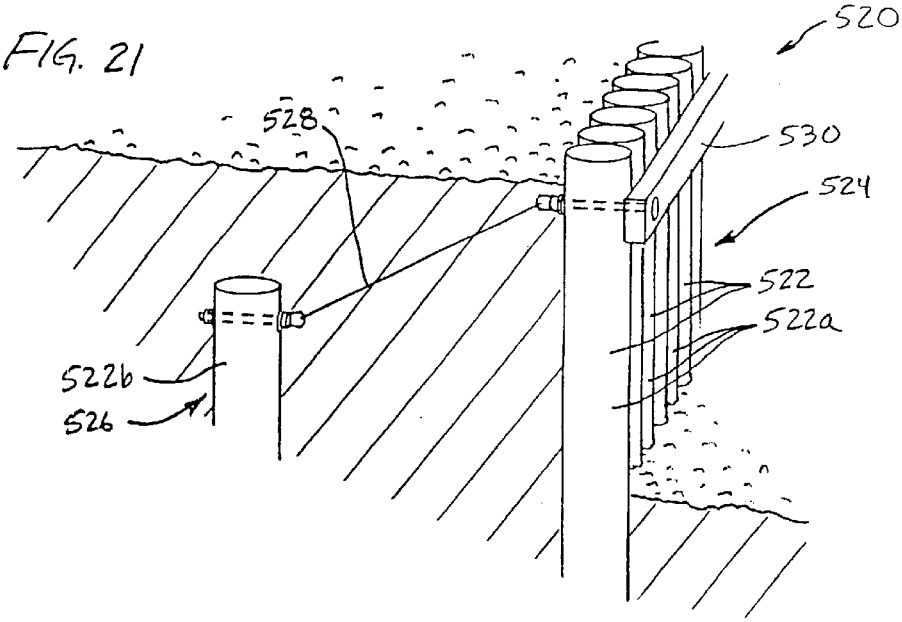
FIG. 21 depicts another exemplary wall system employing pile members of the present invention.

Referring now to FIG. 21, depicted 520 therein is a retaining wall system employing piles 522 constructed in accordance with, and installed using, the principles of the present invention. A plurality of the pile members 522*a* are driven adjacent to each other as described above to form a wall portion 524 of the system 520. One or more pile members 522*b* are driven behind the wall portion 524 to form anchor portions 526 of the wall system 520. A cable or other tension member 528 is affixed at one end to the anchor portions 526 and at another end to the wall portion 524 to support the wall portion 524 against the loads created by earth back-filled against the wall portion 524. A tie beam 530 helps to distribute the anchoring forces along the pile members 522*a* that form the wall portion 524.

Figure 22:
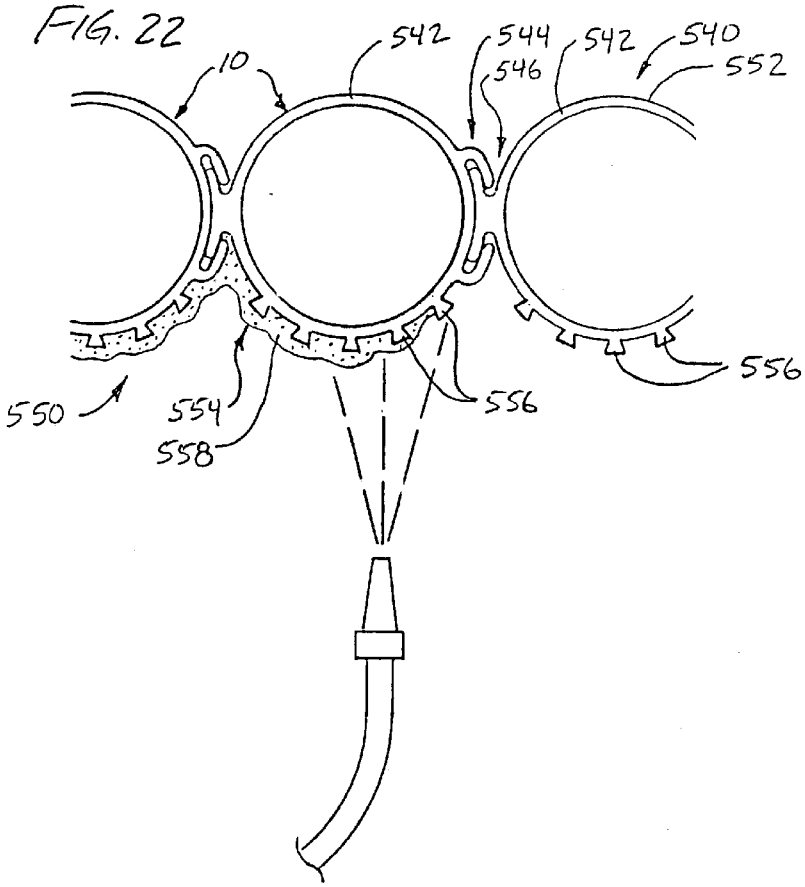
FIG. 22 depicts pile members textured or contoured to allow flowable, settable material to be sprayed on to form a surface coating on the pile members.

Referring now to FIG. 22, depicted 540 therein are a plurality of pile members similar to the pile members 10 described above. The pile members 540 comprise a body portion 542 and at least one channel portion 544 and/or at least one rail portion 546. The channel portions 544 engage the rail portions 546 as described above to interlock the pile members 540.

The body portion 542 comprises a wall 550 defining an inner surface 552 and an outer surface 554. Formed on the wall outer surface 554 are adhering projections 556 that enhance the ability of a hardenable coating material 558 to adhere to the wall outer surface 554 when set. The exemplary projections 556 are dovetail-shaped such that the coating material 558 flows around and behind a portion of the projections to positively bind the coating material 558 to the wall 550. However, the adhering projections 556 may be any shape that helps to form a mechanical engagement between the wall 550 and the hardened coating material 558.

The coating material 558 may be concrete, stucco material, or any other material that may be applied to the pile members 540 for decorative, protective, or other reasons. The coating material 558 is perhaps most effectively applied by spraying as shown but may be applied by trowel, brush, or other techniques.

A similar effect may be obtained by the exemplary pile member 10*d* described above with reference to FIG. 5. Normally, only one or perhaps two of the channel portions 22 will be used in a given installation. When the pile member 10*d* is used as part of a wall system with one face exposed, one or perhaps two of the channel portions 22 will also be exposed and accessible; these exposed channel portions 22 form adhering projections that would enable a coating material to be more effectively adhered to the pile member 10*d*.

In addition, the exposed channel portions 22 would allow other gear to be attached to the exposed face of the wall formed by the pile members 10*d*. For example, to attach a tie beam as depicted at 530 above to the pile 10*d*, a bracket may be provided that defines a vertical rail portion for engaging the exposed channel portion and flanges that engage the tie beam.

Figure 23:
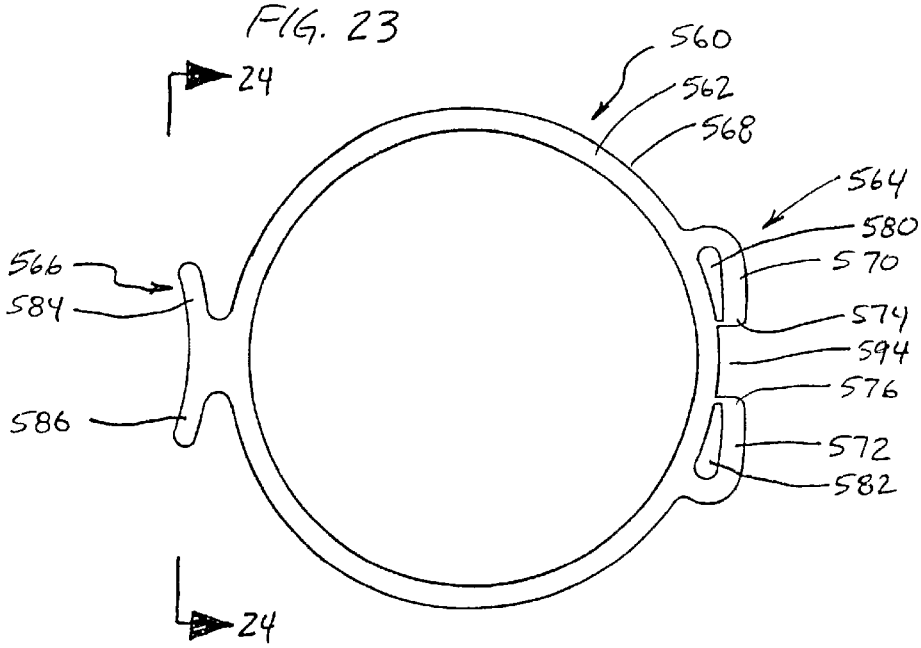
FIG. 23 is a top plan view of another pile member of the present invention having a closed channel portion to facilitate driving of the pile member and subsequent insertion of an adjacent pile member.
Figure 24:
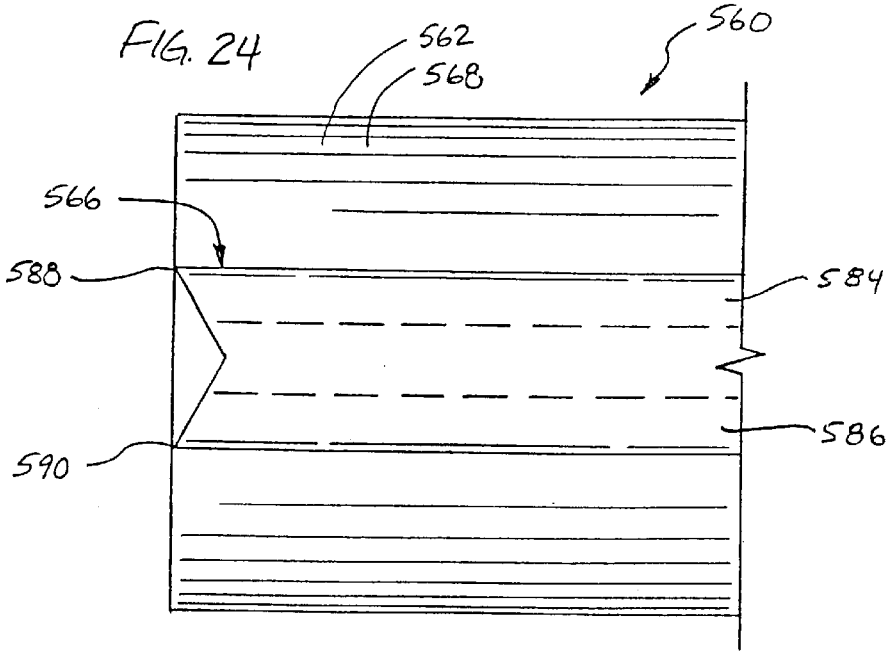
FIG. 24 is a side elevation view depicting pointed end portions of a rail member adapted to engage the closed channel portion of the pile of FIG. 23.

Depicted at 560 in FIGS. 23 and 24 is a pile member constructed in accordance with another embodiment of the present invention. The pile member 560 is similar to the pile members 10 described above and will be described herein primarily to the extent that it differs from those pile members 10.

FIG. 23 shows that the exemplary pile member 560 comprises a main body 562, a channel portion 564, and a rail portion 566. The main body defines an outer surface 568.

The exemplary channel portion 564 comprises first and second channel arms 570 and 572. The channel arms 570 and 572 comprise first and second tip portions 574 and 576. The channel portion 564 is initially in a closed state in which the tip portions 570 and 572 are attached to the outer surface 568 to define elongate cavities 580 and 582. The elongate cavities 580 and 582 are closed, or at least very small in cross-sectional area, at their lower end. Accordingly, as the pile member 560 is driven, dirt and other debris is not likely to accumulate in the cavities 580 and 582.

The exemplary rail portions 566 comprise first and second rail flanges 584 and 586. As shown in FIG. 24, lower tips 588 and 590 of these flanges 580 and 582 are pointed and spaced from each other the same distance as the elongate cavities 580 and 582. When one pile member 560 is to be driven adjacent to a previously driven pile member 560, the pointed lower tips 588 and 590 of the second pile member are arranged above the open upper ends of the elongate cavities 580 and 582 of the previously driven pile member. As the lower tips 588 and 590 move into the cavities 580 and 582, the channel arm tips 570 and 572 are separated from the pile outer surface 568 to form a channel 594 that receives the rail portions 566 to lock the adjacent pile members 560 together.

Figure 25:
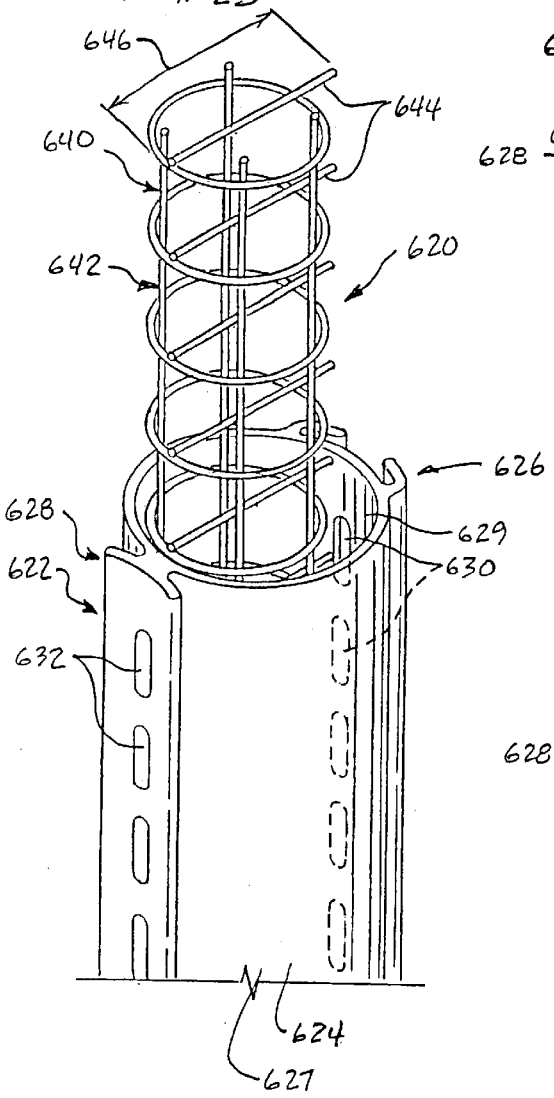
FIG. 25 is a perspective view showing the insertion of a reinforcing bar cage assembly into a pile member of the present invention having side openings formed therein.
Figure 26:
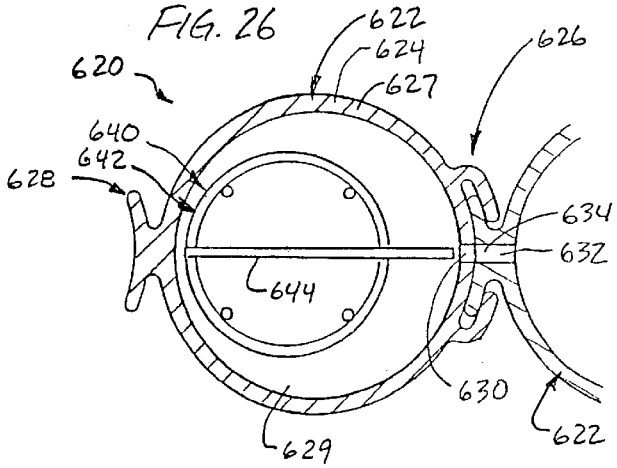
FIG. 26 is a top plan view of a wall assembly of the present invention depicting the location of the reinforcing bar cage assembly during the process of forming a wall assembly.
Figure 27:
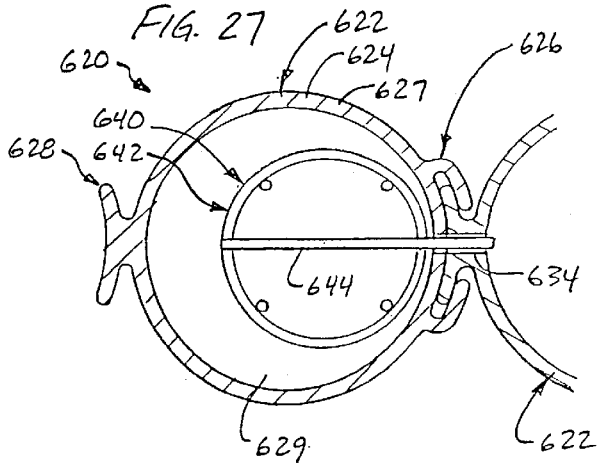
FIG. 27 is a top plan view of the wall assembly of FIG. 26 in which at least a portion of the cage assembly extends from one pile member into an adjacent pile member.

Referring now to FIGS. 25–27, depicted therein is yet another wall system 620 comprised of pile members 622 constructed in accordance with, and embodying, the principles of the present invention. The pile members 622 are similar to the pile members 10 described above and will be described herein primarily to the extent that they differs from those pile members 10.

FIGS. 25–27 show that the exemplary pile member 622 comprises a main body 624, a channel portion 626, and a rail portion 628. The main body 624 defines a pile wall 627 and pile chamber 629. Channel and rail side openings 630 and 632 are formed in the pile wall 627. As described above, when the pile members 622 are properly driven adjacent to each other, the channel and rail side openings align to form cross-passageways 634.

The wall system 620 further comprises a reinforcing assembly 640. The reinforcing assembly 640 is made of a reinforcing material such as metal rebar and comprises a cage portion 642 and at least one lateral portion 644. As shown in FIGS. 26 and 27, the cage portion 642 and lateral portion 644 define a top dimension 646 that is slightly smaller than a diameter of the pile chamber 26. The entire reinforcing assembly 640 thus may be inserted into the pile chamber 629 as shown in FIG. 25. Once the reinforcing assembly 640 is in the pile chamber 629, it is displaced laterally such that the at least one lateral portion 644 passes through the cross passageways 634 defined by the aligned side openings 630 and 632 as shown in FIG. 27.

While the reinforcing assembly 640 will provide some additional strengthening of the wall system 620 when arranged as shown in FIG. 27, the primary utility of the reinforcing assembly 640 is to reinforce a settable material such as shown at 334 in FIG. 17 (not shown in FIG. FIGS. 25–27 for purposes of clarity). The cage portion 642 will reinforce the settable material in the pile chamber 629, while the lateral portion 644 will reinforce the settable material forming the bridge portions of settable material that hardens in the cross-passageways 634.

The wall system 620 thus further preferably comprises the step of introducing flowable settable material into the pile chamber 629 after the step of inserting the reinforcing assembly 640 therein. Once the settable material flows through the cross-passageways and hardens, the wall system 620 is fully strengthened.

Given the foregoing, it should be apparent that the present invention may be embodied in many different embodiments and configurations of these embodiments depending upon the particular use of the present invention. The scope of the present invention should thus be determined by the claims attached hereto and not the foregoing discussion of the preferred embodiments.

What is claimed is:

1. A modular pile system, comprising:

first and second cylindrical plastic pile members each having an upper end and a lower end, detent means for connecting the upper end of the first pile member to the lower end of the second pile member; wherein the detent means allow the second pile member to be displaced into a desired position relative to the first pile member but substantially prevent relative movement between the first and second pile members when the second pile member is in the desired position.

2. A modular pile system as recited in claim 1, in which the detent means comprises:

at least one detent hole formed in one of the upper end of the first pile member and the lower end of the second pile member; and at least one detent projection formed on the other of the upper end of the first pile member and the lower end of the second pile member; where the first and second pile members are configured such that the upper end of the first pile member engages the lower end of the second pile member to cause the detent projection to enter the detent hole when the second pile member is in the desired position.

3. A modular pile system as recited in claim 2, in which:

the first and second pile members are hollow; and a shape of one of the upper end of the first pile member and the lower end of the second pile member is altered such that one of the upper end of the first pile member and the lower end of the second pile member is received within the other of the upper end of the first pile member and the lower end of the second pile member.

4. A modular pile system as recited in claim 3, in which respective diameters of the upper end of the first pile member and the lower end of the second pile member are different.

5. A modular pile system as recited in claim 1, in which the detent means comprises a connecting member, where:

first and second detent holes are formed in the upper end of the first pile member and the lower end of the second pile member, respectively; and first and second detent projections are formed on the connecting member; where the first and second pile members and connecting member are configured to cause the first and second detent projections to enter the first and second detent holes, respectively, when the second pile member is in the desired position.

6. A modular pile system as recited in claim 5, in which:

the first and second pile members are hollow; and first and second portions of the connecting member are received within the upper end of the first pile member and the lower end of the second pile member, respectively.

7. A modular pile system as recited in claim 5, in which:

the connecting member is hollow; and first and second portions of the connecting member receive the upper end of the first pile member and the lower end of the second pile member, respectively.

8. A modular pile system as recited in claim 1, in which:

the first and second pile members are hollow; and filler material is introduced into the first and second pile members.

9. A modular pile system as recited in claim 8, further comprising reinforcing material disposed within the filler material to reinforce the filler material.

10. A modular pile system as recited in claim 1, further comprising:

a shoe member; and shoe member detent means for connecting shoe member to the lower end of the first pile member to facilitate driving of at least one of the first and second pile members into the ground.

11. A method of forming a pile comprising the steps of:

providing first and second cylindrical plastic pile members each having an upper end and a lower end, providing detent means for connecting the upper end of the first pile member to the lower end of the second pile member; and displacing the second pile member into a desired position relative to the first pile member; whereby the detent means allows the second pile member to be displaced into the desired position relative to the first pile member but substantially prevents relative movement between the first and second pile members when the second pile member is in the desired position.

* * * * *